US007516866B2

(12) United States Patent
Brook et al.

(10) Patent No.: US 7,516,866 B2
(45) Date of Patent: Apr. 14, 2009

(54) BEVERAGE BARRICADE

(76) Inventors: Tammy Jo Brook, 2750 14th Ave. SE, St. Cloud, MN (US) 56304; Tamara Monosoff, 125 Grover La., Walnut Creek, CA (US) 94596

( * ) Notice: Subject to any disclaimer, the term of this patent is extended or adjusted under 35 U.S.C. 154(b) by 393 days.

(21) Appl. No.: 11/532,798

(22) Filed: Sep. 18, 2006

(65) Prior Publication Data

US 2007/0062951 A1 Mar. 22, 2007

Related U.S. Application Data

(60) Provisional application No. 60/717,934, filed on Sep. 16, 2005.

(51) Int. Cl.
*B65D 17/32* (2006.01)
*B65D 17/34* (2006.01)
*A47G 19/22* (2006.01)

(52) U.S. Cl. ..... 220/254.1; 220/269; 220/258.2; 220/212; 220/258.4; 81/3.55; 81/3.15; D8/18; D8/34; D8/40; D9/436

(58) Field of Classification Search ..... 220/258, 220/269, 212, 719, 713, 711, 254.7, 258.2, 220/254.1, 258.1, 258.4, 258.3; 81/3.55, 81/3.15, 3.09; D8/18, 34, 40; D9/436
See application file for complete search history.

(56) References Cited

U.S. PATENT DOCUMENTS

| | | | | | |
|---|---|---|---|---|---|
| 4,598,435 | A * | 7/1986 | Borodulin et al. | 7/156 |
| 4,873,896 | A * | 10/1989 | Hull | 81/3.27 |
| 4,967,622 | A * | 11/1990 | Phillips | 81/3.09 |
| 5,351,853 | A * | 10/1994 | Shock | 220/729 |
| 5,509,380 | A * | 4/1996 | Tipp | 81/3.55 |
| 5,911,794 | A * | 6/1999 | Nordhoff | 81/3.55 |
| 6,082,030 | A * | 7/2000 | Kesselring et al. | 40/307 |
| 6,098,830 | A * | 8/2000 | Jamieson | 220/259.1 |
| 6,212,721 | B1 * | 4/2001 | Borodulin et al. | 7/156 |
| 6,460,719 | B1 * | 10/2002 | Finmark | 220/258.5 |
| 6,763,963 | B1 * | 7/2004 | Martin | 220/254.2 |
| 2005/0284263 | A1 * | 12/2005 | Klosterman | 81/3.55 |

* cited by examiner

*Primary Examiner*—Anthony D Stashick
*Assistant Examiner*—Niki M Eloshway
(74) *Attorney, Agent, or Firm*—West and Associates, A PC; Stuart J. West; Charlotte Rodeem-Dickert

(57) ABSTRACT

A device that removably couples with the tab of a beverage container to assist in opening the container and then rotates to close the opening, thus preventing things such as insects and debris from contaminating the beverage.

7 Claims, 3 Drawing Sheets

BEVERAGE BARRICADE

CLAIM OF PRIORITY

This application claims the benefit of U.S. Provisional Application No. 60/717,934, filed Sep. 16, 2005, the complete contents of which is hereby incorporated herein by reference.

BACKGROUND

1. Field of the Invention

The present disclosure is for a device that assists in opening beverage containers, temporarily closes the opening of an opened beverage container, and also provides an identification marker for said container.

2. Related Art

Beverages in aluminum cans are commonplace in homes and at gatherings and events. However, sometimes there can be complications and potential safety hazards in using these simple beverage containers.

First, some persons can have difficulty pulling up the tab on the top of the can that "pops" open the can. The tab often sits tight against the can top, so a person must get a fingernail underneath the tab edge to lift it. If the tab is especially tight, the person could break a nail trying to open the can. Sometimes, a person must use a dining utensil or other available tool to open the can.

Next, once the can has been opened, bugs, dirt, or other debris can enter the can and contaminate the beverage. When drinking the beverage outdoors, stinging insects, such as bees and wasps, can pose a particular danger. These insects, attracted by the sugars that are often in canned beverages, enter the opened can. When the consumer of the beverage takes a sip, the insect could sting him, resulting in a potentially serious injury.

Finally, the inside edge of the opening can be very sharp. Children may try to stick their fingers into the opening and potentially end up with painful cuts.

What is needed is a device that helps a person open a beverage container and then temporarily covers the opening.

DETAILED DESCRIPTION

Figure 1:
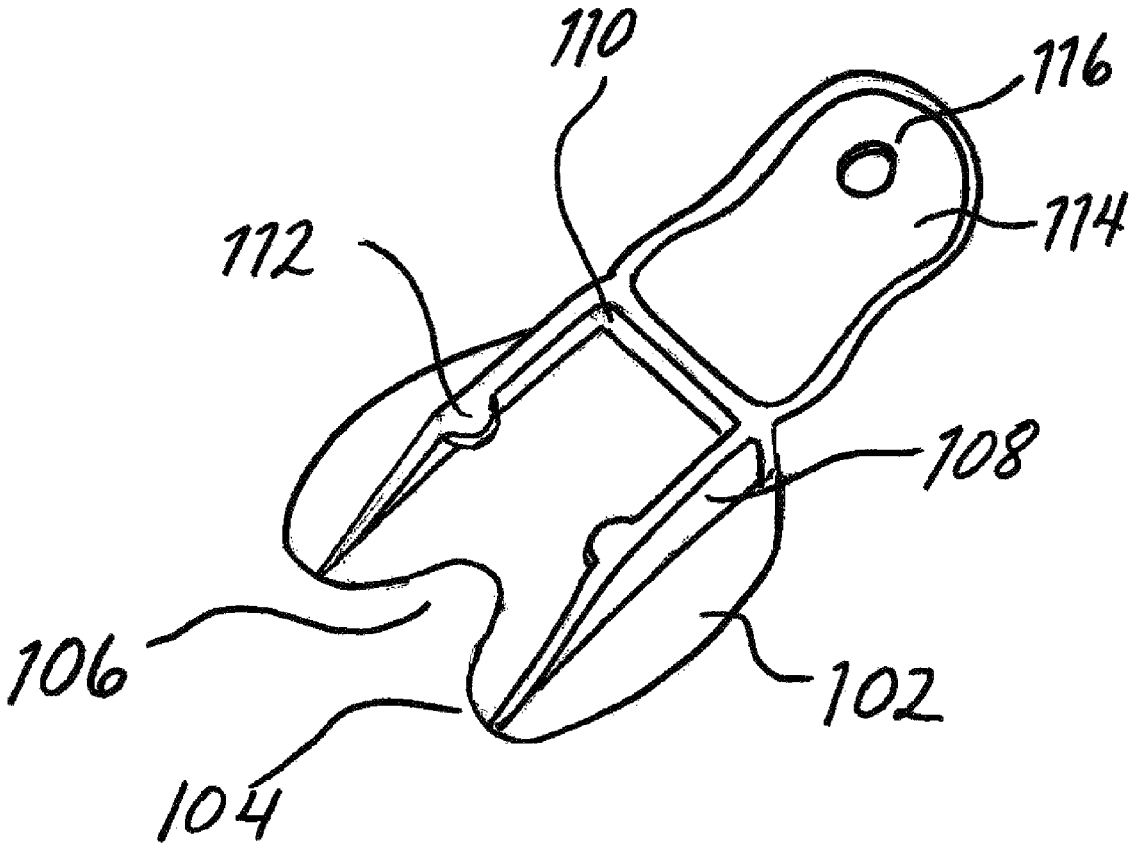
FIG. 1 depicts a perspective view of the top side of an embodiment of the present device.

FIG. 1 depicts a perspective view of an embodiment of the present device. A substantially planar base member 102 has a pair of substantially planar members 104 protruding from the distal edge of said base member 102. Said protruding members 104 can be oriented downward at an acute angle relative to the bottom surface of said base member 102. A notch 106, which can be curved, separates said pair of protruding members 104. Said notch can be curved to a radius slightly larger than that of the fastener affixing a tab to the top of a beverage container, or any other known and/or convenient geometry. Although depicted here as curved, the base member 102 and protruding members 104 can be any known and/or convenient geometry.

A pair of substantially parallel ridges 108, extending from the proximal edge of the base member 102 to the distal edges of the protruding members 104, protrude substantially perpendicularly from the top surface of said base member 102. Said ridges 108 can be separated by a distance slightly greater than the width of a beverage container tab, such that the tab can fit between said ridges 108. In some embodiments, as shown in FIG. 1, the height of said ridges 108 can taper down to the distal edges of said protruding planar members 104. In some embodiments, as shown in FIG. 1, an additional ridge 110, oriented substantially perpendicular to the proximal ends of a pair of ridges 108 can continuously connect a pair of ridges 108 substantially along the proximal edge of a base member 102.

In some embodiments, as shown in FIG. 1, a pair of tabs 112 can be attached substantially perpendicularly to the top edges of each of the substantially parallel ridges 108 such that these tabs protrude inward. In other embodiments, tabs 112 can be extended to form a continuous member joining the substantially parallel ridges 108. Alternatively, a tab 112 can protrude from an additional ridge 110 toward the distal edge of the planar member 102 either in place of, or in addition to, tabs 112 protruding from a pair of substantially parallel ridges 108.

In FIG. 1, an elongated member 114 extends back from the proximal edge of a base member 102. An elongated member 114 can be affixed to a ridge 110 substantially along the proximal edge of a planar base member 102 so that an elongated member 114 sits above a planar base member 102. A hole 116 of any known and/or convenient geometry can be cut into an elongated member 114. Although shown here with a rounded shape an elongated member 114 can be of any known and/or convenient geometry.

Figure 2:
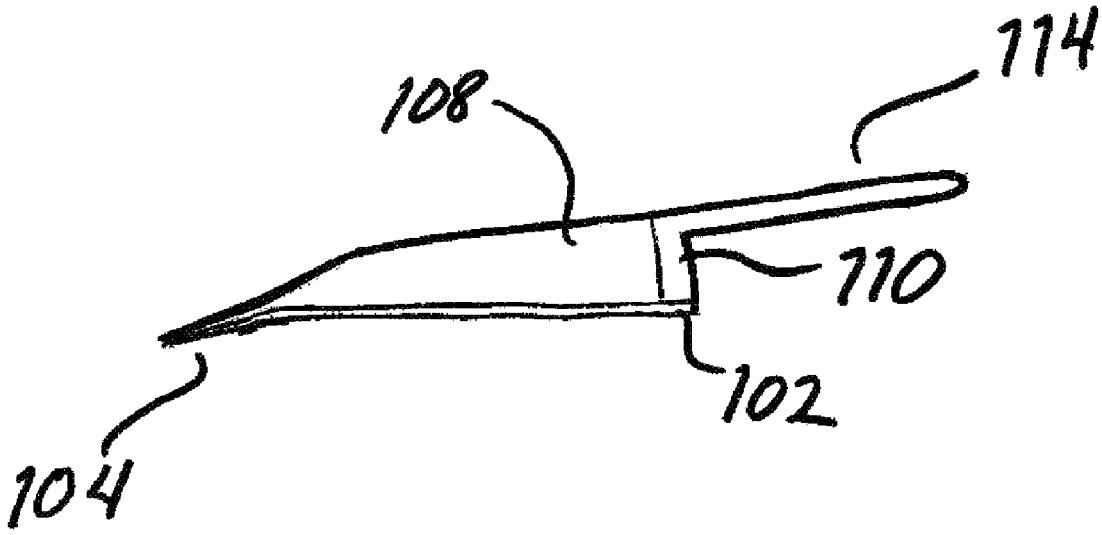
FIG. 2 depicts a side view of an embodiment of the present device.

FIG. 2 depicts a side view of an embodiment of the present device. A substantially parallel ridge 108 can have a maximum height at its distal end that tapers toward its proximal end. In some embodiments, the angle of the taper can increase as a ridge extends along a protruding planar member 104. The height of a ridge 108 diminishes to substantially zero at the distal edge of a protruding planar member 104. The elongated member 114 can be elevated at the same angle by which the height of the ridge 108 tapers toward the distal edge of the base member 102.

Figure 3:
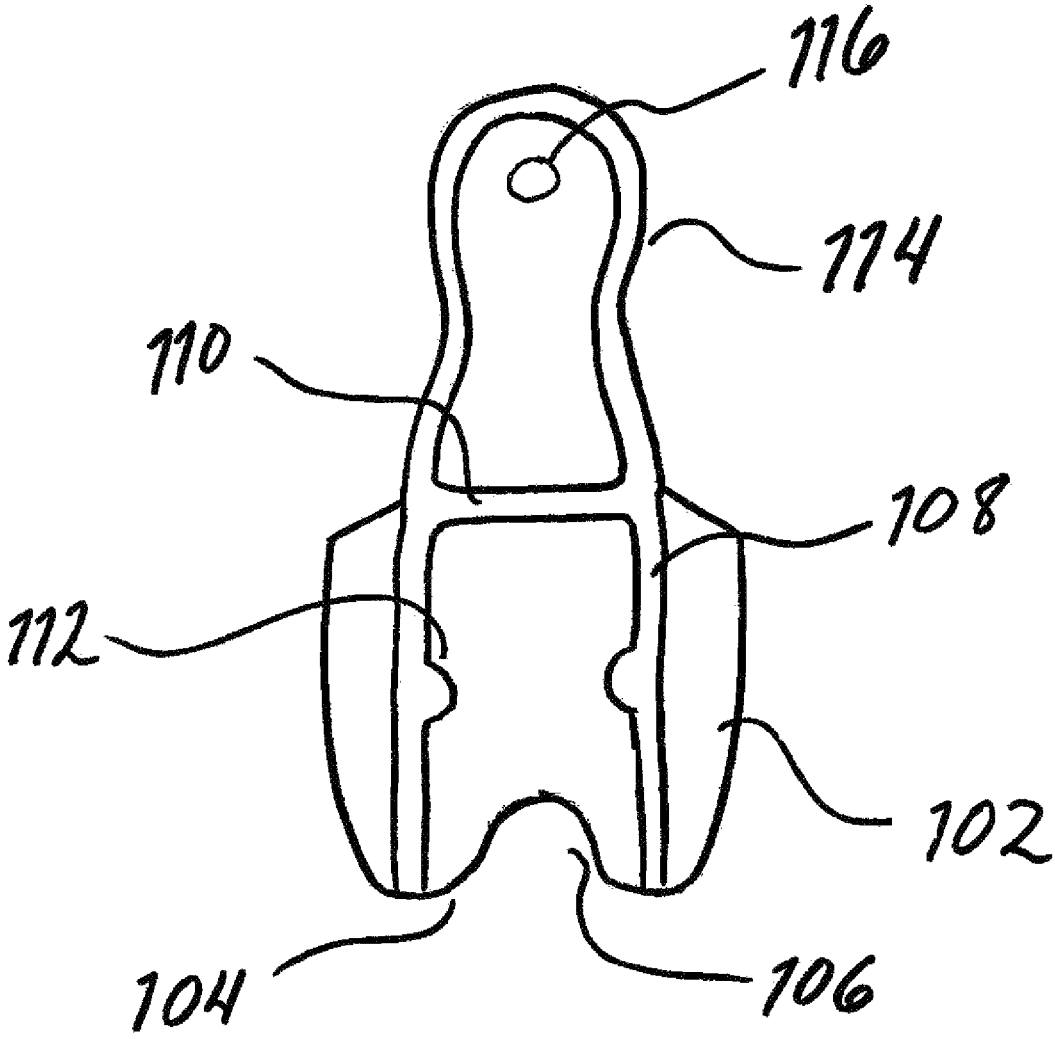
FIG. 3 depicts a top view of an embodiment of the present device.

FIG. 3 shows a top view of an embodiment of the present device. In some embodiments, an additional ridge 110 can connect a pair of substantially parallel ridges 108. However, in other embodiments, a ridge 110 can be omitted.

In operation, a user removably couples the present device with the tab of a beverage container as follows. The device slips underneath a tab of a beverage container, such that the can tab sits between the substantially parallel ridges 108 and is held in place by the tabs 112 extending from the ridges 108. The notch 106 fits around the connector between the tab and the top of the container. Pulling upward on the elongated member 116, gives the user increased leverage on the tab to open the container. Once the container is opened, rotating the container tab with the present device attached allows the base member 102 to cover the opening in the beverage container. To take a sip from the beverage container, the user then rotates the container tab and the present device until the container opening is uncovered.

The present device can be manufactured from a polymer, plastic, metal, or any other known and/or convenient material. Also, it can be produced in various colors, which can help users identify their personal beverages in situations where many similar opened beverage containers are around, such as at a social gathering. In addition, the present device can be embossed, engraved, imprinted with graphics and/or text for advertising or any other known and/or convenient purpose.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A device to assist in opening and temporarily closing a beverage can, comprising:

a substantially planar base member, having a proximal edge and a distal edge and a top surface and a bottom surface;

a pair of substantially planar members protruding from the distal edge of said planar base member, having a notch between said protruding planar members;

a pair of substantially parallel ridges protruding substantially perpendicularly from said top surface of said base member, each having a proximal end and a distal end and an interior top edge and exterior top edge;

at least one tab protruding substantially perpendicularly from the interior top edges of each of said ridges and oriented substantially parallel to the top surface of said planar member; and an elongated member, wherein said member is affixed to the proximal edge of said planar base member.

2. The device of claim 1, further comprising a ridge protruding substantially perpendicularly from said top surface of said base member and connecting the proximal ends of said pair of substantially parallel ridges.

3. The device of claim 2, wherein said elongated member is affixed to the ridge connecting the proximal ends of said pair of substantially parallel ridges.

4. The device of claim 2, wherein said elongated member is elevated at an acute angle relative to the base member.

5. The device of claim 2, wherein said substantially planar protruding members are oriented at an acute angle relative to said substantially planar base member.

6. The device of claim 2, wherein said notch is rounded.

7. The device of claim 2, wherein said proximal edge of the base member is curved.

* * * * *